US008871075B2

(12) United States Patent
Byeon et al.

(10) Patent No.: US 8,871,075 B2
(45) Date of Patent: Oct. 28, 2014

(54) METHOD OF FORMING METAL PATTERN AND METHOD OF MANUFACTURING DISPLAY SUBSTRATE HAVING THE SAME

(75) Inventors: Jeong-Hoon Byeon, Incheon (KR); In-Seok Yeo, Seoul (KR); Jae-Hyuk Chang, Seongnam-si (KR); Seung-Jun Lee, Yongin-si (KR); Hyun-Seok Kim, Anyang-si (KR); Sung-Hee Lee, Seoul (KR)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 13/405,532

(22) Filed: Feb. 27, 2012

(65) Prior Publication Data

US 2012/0231567 A1 Sep. 13, 2012

(30) Foreign Application Priority Data

Mar. 9, 2011 (KR) ..... 10-2011-0020891

(51) Int. Cl.
*C25D 5/02* (2006.01)

(52) U.S. Cl.
USPC ..... 205/126; 205/125

(58) Field of Classification Search
USPC ..... 205/125, 126; 427/553, 554
See application file for complete search history.

(56) References Cited

U.S. PATENT DOCUMENTS

| | | | | |
|---|---|---|---|---|
| 5,098,526 | A * | 3/1992 | Bernhardt | 205/125 |
| 5,264,108 | A * | 11/1993 | Mayer et al. | 205/125 |
| 5,336,630 | A * | 8/1994 | Yun et al. | 438/253 |
| 5,559,583 | A * | 9/1996 | Tanabe | 355/71 |
| 6,121,076 | A * | 9/2000 | Zhang et al. | 438/150 |
| 6,468,839 | B2 * | 10/2002 | Inoue et al. | 438/149 |
| 6,806,189 | B2 * | 10/2004 | Kim et al. | 438/678 |
| 7,438,950 | B2 * | 10/2008 | Kano et al. | 427/304 |
| 7,446,166 | B2 * | 11/2008 | Lee et al. | 528/423 |
| 7,659,138 | B2 * | 2/2010 | Hirakata et al. | 438/99 |
| 2007/0134902 | A1 * | 6/2007 | Bertino et al. | 438/610 |
| 2008/0135980 | A1 * | 6/2008 | Sasaki et al. | 257/607 |
| 2009/0249976 | A1 * | 10/2009 | Etheridge | 106/31.13 |
| 2010/0311238 | A1 * | 12/2010 | Nakamura et al. | 438/653 |

* cited by examiner

*Primary Examiner* — Reema Patel
(74) *Attorney, Agent, or Firm* — Cantor Colburn LLP

(57) ABSTRACT

A method of forming a metal pattern includes forming a precursor layer including a metal precursor on a substrate, irradiating a light on the precursor layer to form a metal seed layer having a predetermined pattern, and electroless-plating the metal seed layer to form a metal pattern layer.

18 Claims, 9 Drawing Sheets

METHOD OF FORMING METAL PATTERN AND METHOD OF MANUFACTURING DISPLAY SUBSTRATE HAVING THE SAME

This application claims priority to Korean Patent Application No. 2011-0020891, filed on Mar. 9, 2011, and all the benefits accruing therefrom under 35 U.S.C. §119, the contents of which are herein incorporated by reference in their entireties.

BACKGROUND OF THE INVENTION

1. Field of the Invention

Exemplary embodiments of the invention relate generally to flat panel displays. More particularly, exemplary embodiments of the invention relate to a method of forming a metal pattern and a method of manufacturing a display substrate having the metal pattern.

2. Description of the Related Art

Generally, a liquid crystal display ("LCD") panel includes a display substrate, a counter substrate facing the display substrate and a liquid crystal layer interposed between the display substrate and the counter substrate. The display substrate includes a gate line formed on a base substrate and applied with a gate signal, a data line crossing the gate line, a thin-film transistor ("TFT") electrically connected to the gate and data lines, and a pixel electrode electrically connected to the TFT.

As the size and the resolution of the LCD panel increase, the gate and data lines become longer so that a signal delay is occurred. When the gate line and/or the data line have relatively large thickness, or when a signal line includes a metal having a low resistance, the signal delay could be improved.

However, a metal having a low resistance is limitative, and it is difficult to control processes of manufacturing the display substrate such that inherent property of the metal, such as aluminum, copper, is not changed. Moreover, general processes of forming a signal line need a plurality of masks for patterning, a high vacuum deposition process, and several processes such as etching and washing. Therefore, performing the above processes costs high, and noxious substances may be discharged. Moreover, the precision of the signal line is deteriorated and it is hard to form a fine pattern.

BRIEF SUMMARY OF THE INVENTION

Exemplary embodiments of the invention provide a method of forming a metal pattern to form relatively thick signal line in a simple process.

Exemplary embodiments of the invention also provide a method of manufacturing a display substrate including the method of forming a metal pattern.

According to an exemplary embodiment of the invention, a method of forming a metal pattern includes forming a precursor layer including a metal precursor on a substrate, irradiating a light on the precursor layer to form a metal seed layer having a predetermined pattern, and electroless-plating the metal seed layer to form a metal pattern layer.

According to another exemplary embodiment of the invention, a method of manufacturing a display substrate includes forming a gate pattern including gate lines and a gate electrode, forming a source pattern on the substrate including the gate pattern, and forming a pixel electrode on the substrate including the source pattern. The forming a gate pattern includes forming a precursor layer including a metal precursor on a substrate, irradiating a light on the precursor layer to form a metal seed layer having a predetermined pattern, and electroless-plating the metal seed layer to form a metal pattern layer. The source pattern includes date lines, a source electrode and a drain electrode. The pixel electrode is in electrical connection to the drain electrode.

According to the invention, the exposure process and the annealing process are sequentially performed in the one process of irradiating the light from single light source onto the substrate, so that total processes of forming a metal pattern on the substrate are simplified. Moreover, an electroless-plating is performed after forming the metal seed layer, so that a metal pattern having a uniform distribution can be formed on the substrate having large area.

Moreover, the electro-plating is performed after the electroless-plating so that the thickness of the metal pattern layer is increase efficiently. The metal pattern may be formed to have high ratio of width to thickness, so that a signal line having small electric resistance and fast response may be formed.

BRIEF DESCRIPTION OF THE DRAWINGS

The above and other features of the invention will become more apparent by describing in detailed exemplary embodiments thereof with reference to the accompanying drawings, in which.

DETAILED DESCRIPTION OF THE INVENTION

Figure 1:
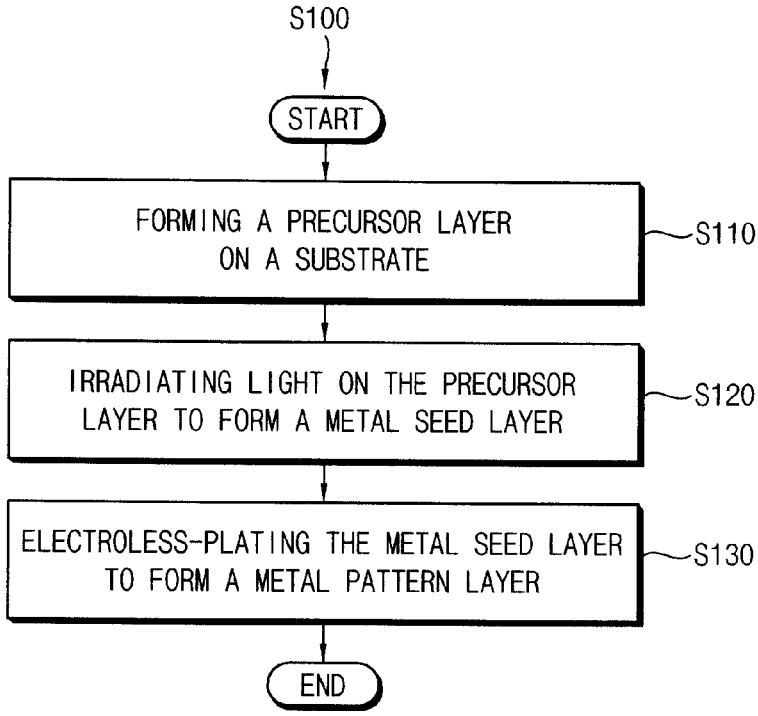
FIG. 1 is a flowchart explaining an exemplary embodiment of a method of forming a metal pattern according to the invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on" or "connected to" another element or layer, the element or layer can be directly on or connected to another element or layer or intervening elements or layers. In contrast, when an element is referred to as being "directly on" or "directly connected to" another element or layer, there are no intervening elements or layers present. As used herein, connected may refer to elements being physically and/or electrically connected to each other. Like numbers refer to like elements throughout. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "under," "above," and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "under" relative to other elements or features would then be oriented "above" relative to the other elements or features. Thus, the exemplary term "under" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, the invention will be explained in detail with reference to the accompanying drawings.

FIG. 1 is a flowchart explaining an exemplary embodiment of a method of forming a metal pattern according to the invention.

Referring to FIG. 1, a method (step S100) of forming a metal pattern includes forming a precursor layer on a substrate (step S110), irradiating a light on the precursor layer to form a metal seed layer (step S120) and electroless-plating (e.g., via electrolysis) the metal seed layer to form a metal pattern layer (step S130). Hereinafter, the steps (steps S110, S120 and S130) will be explained in further detail referring to FIGS. 2A to 7.

Figure 2A:
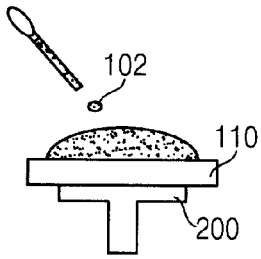
FIGS. 2A to 2C are cross-sectional view explaining an exemplary embodiment of the process of forming a precursor layer in FIG. 1.
Figure 2B:
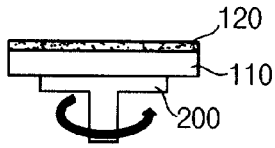
Figure 2C:
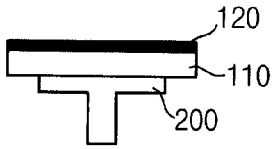

FIGS. 2A to 2C are cross-sectional views explaining the process of forming a precursor layer in FIG. 1.

Referring to FIGS. 1 to 2C, forming a precursor layer (step S110) includes applying a metal precursor solution 102 on a substrate 110, rotating the substrate 110 to spread the metal precursor solution 102 on the substrate 110 and drying the substrate 110.

Referring to FIG. 2A, the substrate 110 is fixed on a spin plate 200, and then the metal precursor solution 102 is applied on the substrate 110. In one exemplary embodiment, for example, the metal precursor includes copper (Cu). Alternatively, the metal precursor may include silver (Ag), titanium (Ti), gold (Au), palladium (Pd), etc. Furthermore, various metal precursors may be used as desired.

Referring to FIG. 2B, the spin plate 200 on which the substrate 110 is fixed, may be rotated. The substrate 110 is rotated with the spin plate 200, thus the metal precursor solution 102 is spread on the substrate 110 to be uniformly distributed on the substrate 110.

Referring to FIG. 2C, the substrate 110 including the spread metal precursor solution 102 is subjected to a drying operation to form a precursor layer 120 on the substrate 110. Accordingly, the precursor layer 120 is uniformly distributed on the substrate 110.

Figure 3:
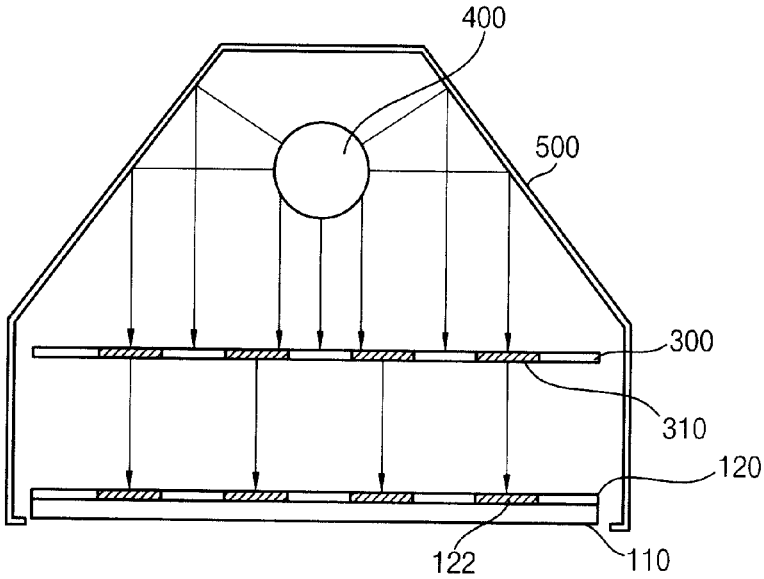
FIG. 3 is a conceptual diagram explaining an exemplary embodiment of the process of forming a metal seed layer in FIG. 1.
Figure 4:
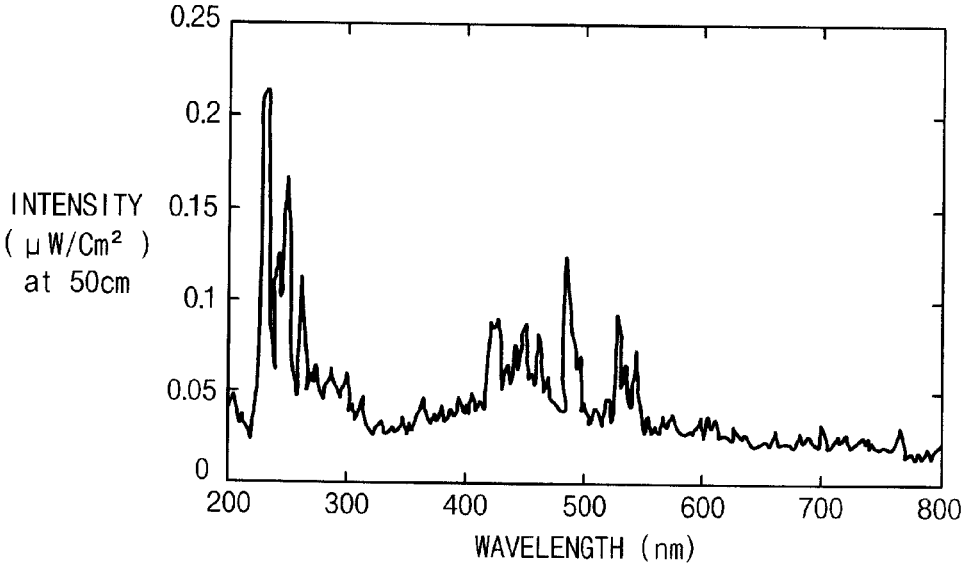
FIG. 4 is a graph illustrating wavelength and intensity of a Xenon (Xe) lamp.

FIG. 3 is a conceptual diagram explaining an exemplary embodiment of the process of forming a metal seed layer in FIG. 1. FIG. 4 is a graph illustrating wavelength in units of nanometer (nm) and intensity in units of ($\mu W/cm^2$), of a Xenon (Xe) lamp.

Referring to FIGS. 1, 3 and 4, forming a metal seed layer (step S120) includes irradiating a light on the precursor layer 120 with a predetermined pattern to expose the precursor layer 120, and annealing the exposed precursor layer 120 by the light.

Referring to FIG. 3, the substrate 110 on which the precursor layer 120 is formed, is disposed in an exposure device 500, and then light is irradiated from a light source 400. A mask 300 having a predetermined pattern 310 is disposed above the substrate 110 so that the light from the light source 400 passes through the pattern 310 of the mask 300. The precursor layer 120 is exposed to the light having passed through the pattern 310 of the mask 300.

The light source 400 has a wavelength having a wide bandwidth. In one exemplary embodiment, for example, the wavelength of the light source 400 has a bandwidth between about 180 nm and about 1000 nm. The light source 400 has certain level of intensity respectively in the wavelength between about 180 nm and about 400 nm, and in the wavelength between about 400 nm and about 1000 nm.

In one exemplary embodiment, for example, the light source 400 may include a Xenon (Xe) lamp. Referring to FIG. 4, the Xenon lamp has certain level of intensity respectively in the wavelength between about 200 nm and about 300 nm, and in the wavelength between about 400 nm and about 600 nm. The light source 400 may be controlled by a control device to have a wavelength having a wide bandwidth. The light source 400 may be controlled to have certain level of intensity respectively in the wavelength between about 180 nm and about 400 nm, and in the wavelength between about 400 nm and about 1000 nm using the control device, and the controlled light source may be used in an exposure process.

The metal precursor in the precursor layer 120 is reduced in the wavelength between about 180 nm and about 400 nm. In one exemplary embodiment, for example, when the metal precursor including a copper precursor is irradiated by the light having the wavelength between about 180 nm and about 400 nm, copper ions of the copper precursor (Cu2+) is reduced into copper (Cu). Therefore, the copper is reduced on the substrate 110 by the light.

The reduced copper is annealed by the light having the wavelength between about 400 nm and about 1000 nm. The reduced copper is stabilized by the annealing process.

The light source 400 has a wavelength having a wide bandwidth between about 180 nm and about 1000 nm, so that the light source 400 may be used both in the exposure process and in the annealing process. In one exemplary embodiment, for example, when the light from the light source 400 is irradiated onto the substrate 100, the metal precursor is reduced in the wavelength between about 180 nm and about 400 nm of the light, and then the reduced metal is annealed in the wavelength between about 400 nm and about 1000 nm of the light.

Referring to FIG. 3, an area 122, where the precursor layer 120 is irradiated by light with a predetermined pattern, is reduced and is sequentially annealed by the light. After the reducing and annealing processes, the area 122 of the precursory layer 120 becomes a metal seed layer 122 formed on the substrate 110 with a predetermined pattern.

After the annealing process, the substrate 110 is washed by a washing process. Through the washing process, the precursor layer 120 is removed except for the metal seed layer 122, so that only the metal seed layer 122 remains on the substrate 110.

According to the illustrated exemplary embodiment of the invention, the exposure process and the annealing process are sequentially performed in the one process of irradiating the light from the light source 400 onto the substrate 110, so that total processes of forming a metal pattern on the substrate is simplified. Moreover, the washing process may be also simplified.

Figure 5:
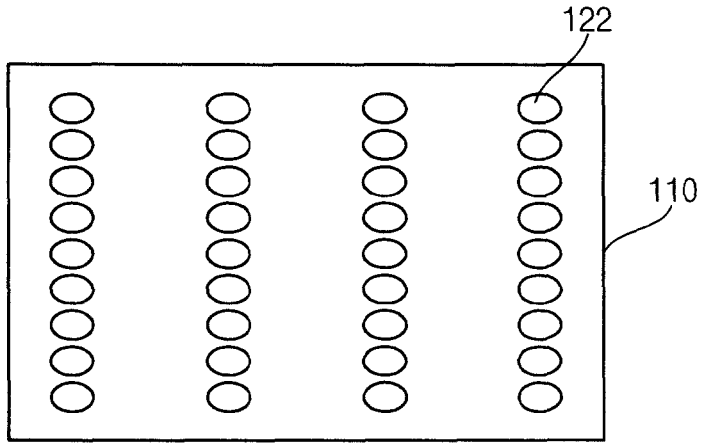
FIG. 5 is a plan view illustrating an exemplary embodiment of a substrate after the process of forming a metal seed layer in FIG. 1.

FIG. 5 is a plan view illustrating an exemplary embodiment of a substrate after the process of forming a metal seed layer in FIG. 1.

Referring to FIG. 5, the metal seed layer 122 which has a predetermined pattern remains on the substrate 110 after the washing process. The metal seed layer 122 is used as a plating seed in an electroless-plating process. In one exemplary embodiment, for example, the metal seed layer 122 includes a plurality of metal seeds having a dot shape. The metal seed layer 122 may include any of a number of shapes of discrete, individual elements.

Figure 6:
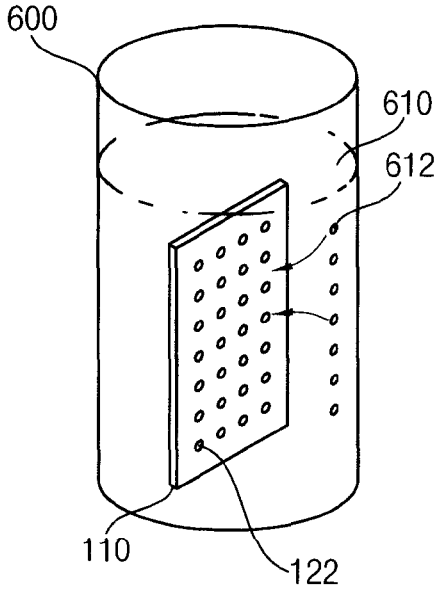
FIG. 6 is a conceptual diagram explaining an exemplary embodiment of the process of electroless-plating in a process of forming a metal pattern layer in FIG. 1.
Figure 7:
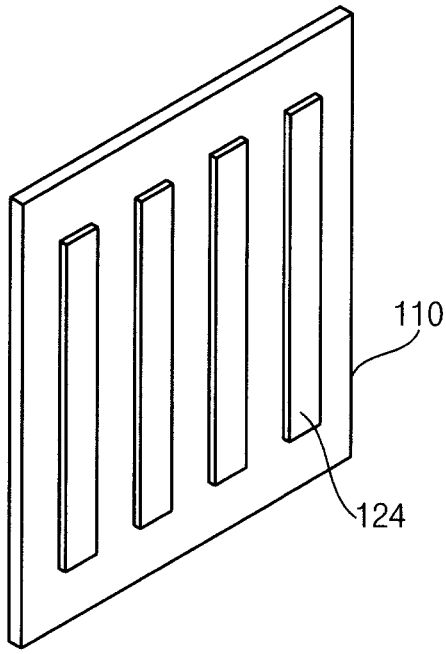
FIG. 7 is a perspective view illustrating an exemplary embodiment of a substrate after the process of forming a metal pattern layer in FIG. 1.

FIG. 6 is a conceptual diagram explaining an exemplary embodiment of the process of electroless-plating in a process of forming a metal pattern layer in FIG. 1. FIG. 7 is a perspective view illustrating an exemplary embodiment of a substrate after a process of forming a metal pattern layer in FIG. 1.

Referring to FIGS. 1, 6 and 7, the substrate 110, where the metal seed layer 122 is formed, is electroless-plated to form a metal pattern layer on the substrate 110 (step S130).

Referring to FIGS. 1 and 6, plating solution 610 including a soluble oxidizer is filled in an electroless-plating device 600, and the soluble oxidizer includes a second metal 612. Thereafter, the substrate 110 is exposed to the plating solution 610. The metal seed layer 122 includes a first metal which has a reducing power smaller than that of the second metal. In one exemplary embodiment, for example, the first metal includes copper (Cu), and the second metal includes silver (Ag). Due to difference of ionization energy between the first and second metals, copper of the metal seed layer 122 is substituted with silver by Equation 1 as follows.

$$Cu+2[Ag(NH_3)_2]NO_3=[Cu(NH_3)_4](NO_3)_2+2Ag \quad \text{[Equation 1]}$$

In above substitution process, the metal seed layer 122 is used as a plating seed, so that the second metal is continuously reduced. Therefore, a metal pattern layer 124 having a predetermined line shape is formed. In the process, groups of the discrete, individual elements of the metal seed layer 122 collectively form a sub-pattern of the metal pattern layer 124.

Referring to FIG. 7, after the electroless-plating process, a metal pattern layer 124 having a predetermined line pattern is formed on the substrate 110. The metal pattern layer 124 includes a plurality of line patterns, each being a single, unitary, indivisible member which is formed from a group of the discrete, individual elements of the metal seed layer 122.

According to the illustrated exemplary embodiment of the invention, an electroless-plating is performed after a metal seed layer is formed on a substrate, so that a metal pattern having a uniform distribution can be formed on the substrate having a large area. Therefore, a fine metal pattern can be formed more uniformly and precisely. Moreover, a fine metal pattern having a width smaller than 0.1 micrometer (μm) can be formed according to the resolution of the mask 300. When the metal seed layer includes copper, cost for a metal patterning process can be reduced.

Figure 8:
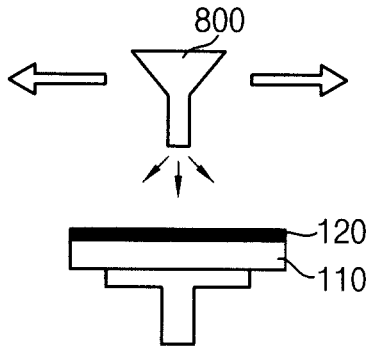
FIG. 8 is a conceptual diagram explaining another exemplary embodiment of the process of forming a precursor layer according to the invention.

FIG. 8 is a conceptual diagram explaining another exemplary embodiment of the process of forming a precursor layer according to the invention. A method of forming a metal pattern according to the illustrated exemplary embodiment is substantially the same as the method of forming a metal pattern according to the exemplary embodiment shown in FIG. 1 except for the process of forming a precursor layer. Thus, the same reference numbers will be used throughout the drawings to refer to the same or like parts, and any repetitive explanation will be omitted.

Referring to FIGS. 1 and 8, in forming a precursor layer 120 on the substrate, a metal precursor 102 is uniformly distributed on the substrate 110 using a uniform droplet diffuser 800 to form the precursor layer 120. The uniform droplet diffuser 800 moves evenly above the substrate 110, so that the precursor layer 120 is formed uniformly on the substrate 110. The uniform droplet diffuser 800 uniformly diffuses droplet on the substrate. In one exemplary embodiment, for example, the uniform droplet diffuser 800 may include a spray, an electrospray, etc. Furthermore, any uniform droplet diffuser that can uniformly diffuse droplet may be used instead of the spray and the electrospray.

Figure 9:
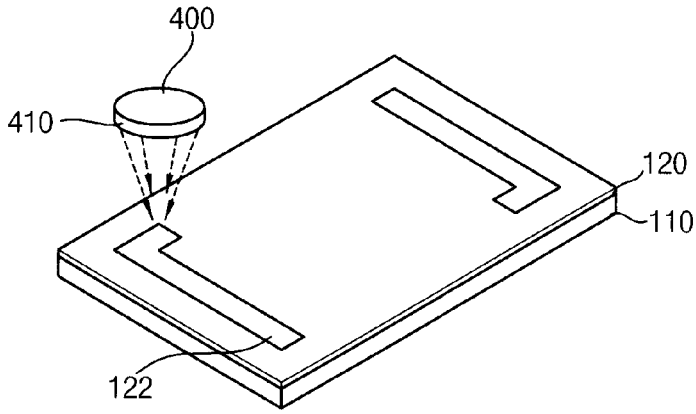
FIG. 9 is a conceptual diagram explaining another exemplary embodiment of the process of forming a metal seed layer according to the invention.

FIG. 9 is a conceptual diagram explaining another exemplary embodiment of the process of forming a metal seed layer according to the invention. A method of forming a metal pattern according to the illustrated exemplary embodiment is substantially the same as the method of forming a metal pattern according to the exemplary embodiment shown in FIG. 1 except for the process of forming a metal seed layer. Thus, the same reference numbers will be used throughout the drawings to refer to the same or like parts, and any repetitive explanation will be omitted.

Referring to FIGS. 1 and 9, in the process of irradiating a light on the precursor layer 120 to form a metal seed layer, the light from the light source 400 is condensed by a condenser 410 without a mask, and the precursor layer 120 is irradiated by the condensed light. In one exemplary embodiment, for example, the condenser 410 is disposed on the light source 400, and the light condensed by the condenser 410 is directly irradiated on the substrate 110 with a predetermined pattern using moving device, such as moving stage (not shown). Accordingly, a metal seed layer 124 can be selectively formed on the substrate 110 from the precursor layer 120, with a predetermined pattern. Therefore, a mask can be omitted in the process of irradiating a light on the precursor layer 120, and total processes of forming a metal pattern layer can be substituted for an in-line process.

Figure 10:
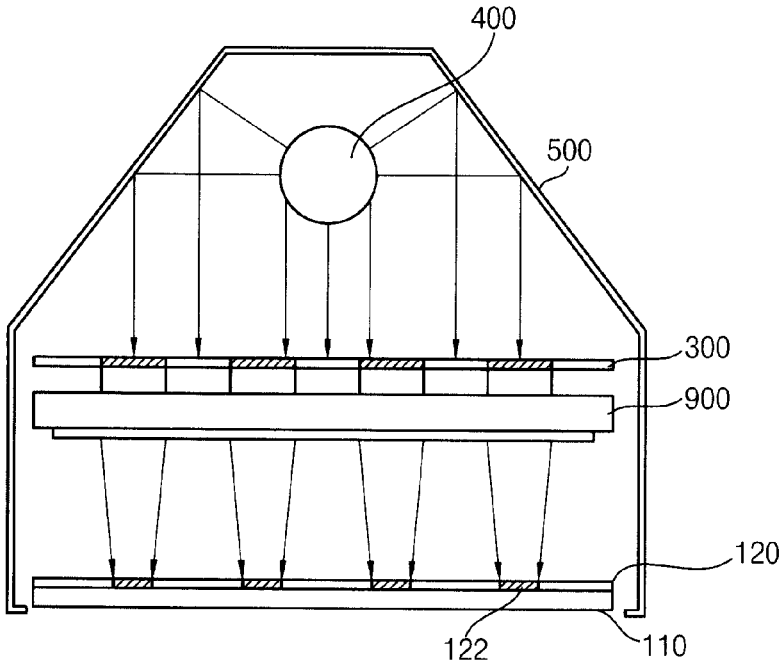
FIG. 10 is a conceptual diagram explaining still another exemplary embodiment of the process of forming a metal seed layer according to the invention.

FIG. 10 is a conceptual diagram explaining still another exemplary embodiment of the process of forming a metal seed layer according to the invention. A method of forming a metal pattern according to the illustrated exemplary embodiment is substantially the same as the method of forming a metal pattern according to the exemplary embodiment shown in FIG. 1 except for the process of forming a metal seed layer. Thus, the same reference numbers will be used throughout the drawings to refer to the same or like parts, and any repetitive explanation will be omitted.

Referring to FIGS. 1 and 10, in the process of irradiating a light on the precursor layer 120 to form the metal seed layer 122, a condensing lens 900 is disposed under the mask 300 which is disposed in the exposure device 500. The light having passed through the mask 300 is condensed and refined by the condensing lens 900. The condensed and refined light is irradiated on the precursor layer 120, so that the metal seed layer 122 formed through the exposure and annealing processes may be uniform and stable. Moreover, a damage of the mask 300 can be minimized and a resolution of pattern can be improved. In the illustrated exemplary embodiment, a single condensing lens is used. However, a plurality of condensing lenses may be disposed under the mask 300 corresponding to the pattern of the mask 300, or the substrate 110 may move in various patterns on a moving stage (not illustrated).

Figure 11:
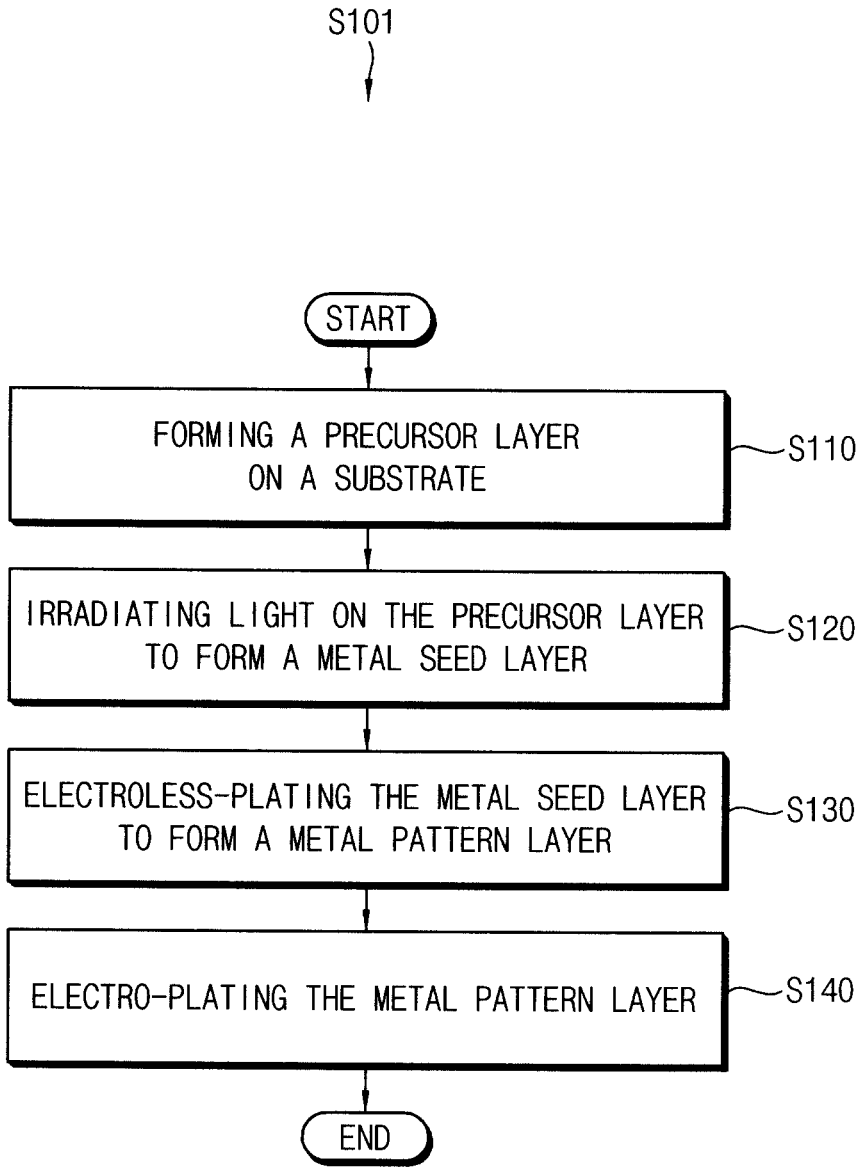
FIG. 11 is a flowchart explaining another exemplary embodiment of a method of forming a metal pattern according to the invention.
Figure 12:
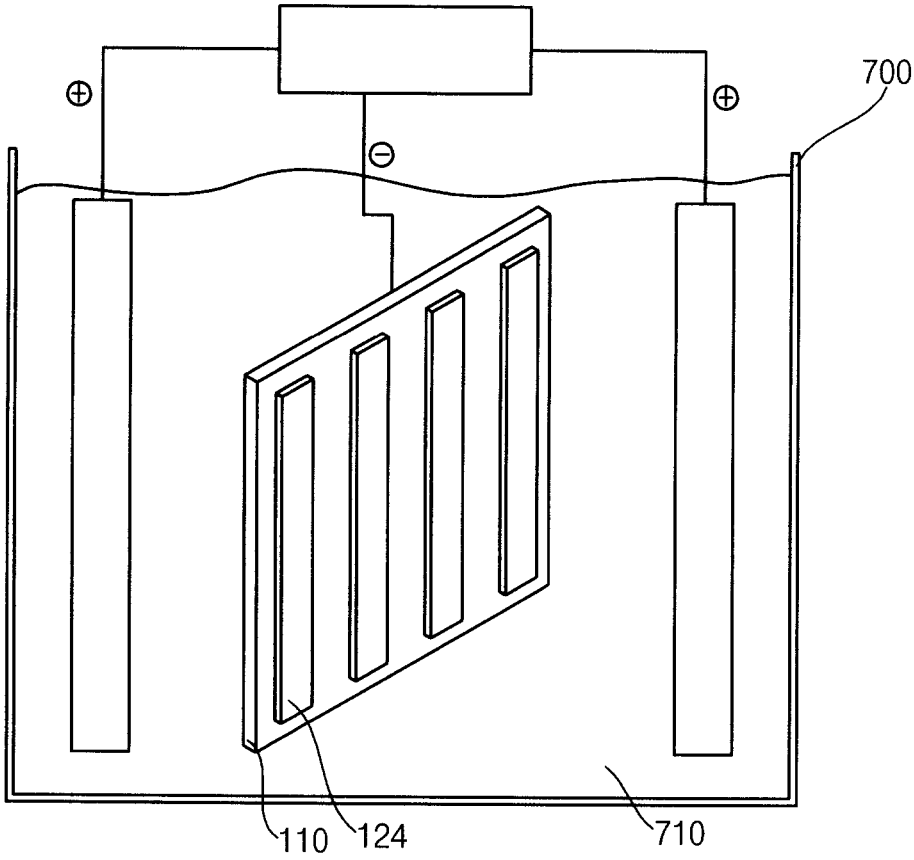
FIG. 12 is a conceptual diagram explaining an exemplary embodiment of the process of electro-plating a metal pattern layer in FIG. 11.

FIG. 11 is a flowchart explaining another exemplary embodiment of a method of forming a metal pattern according to the invention. FIG. 12 is a conceptual diagram explaining an exemplary embodiment of a process of electro-plating a metal pattern layer in FIG. 11.

A method (step S101) of forming a metal pattern according to the illustrated exemplary embodiment is substantially the same as the method of forming a metal pattern according to the exemplary embodiment shown in FIG. 1 except that the substrate, where the metal pattern layer is formed, is electroplated additionally. Thus, the same reference numbers will be used throughout the drawings to refer to the same or like parts, and any repetitive explanation will be omitted.

Referring to FIGS. 11 and 12, the substrate, where the metal pattern layer 124 is formed, is electro-plated (step S140). In one exemplary embodiment, for example, the substrate 110 including the formed metal pattern layer 124 is disposed in an electro-plating device 700, and the metal pattern layer 124 is electrically connected to a cathode of the electro-plating device 700. A plating solution 710 is filled in the electro-plating device 700 and a voltage is applied to the cathode and an anode of the electro-plating device 700, and then the substrate 110 is charged to be a cathode and the plating solution 710 is charged to be an anode. Accordingly, a metal ion of the plating solution 710 is reduced on the metal pattern layer 124 by electrolysis, so that thickness of the metal pattern layer 124 increases. The metal included in the plating solution 710 is chosen to be same as the second metal included in the metal pattern layer 124, so that the thickness of the metal pattern layer 124 may increase.

Accordingly, the electro-plating is performed after the electroless-plating so that the thickness of the metal pattern layer 124 increases efficiently. When only electro-plating is performed in forming a metal pattern layer, a metal layer may be formed quickly, but thickness distribution of the metal layer on large area may not be uniform. However, according to the illustrated exemplary embodiment, the electroless-plating is performed before the electro-plating, so that the speed of forming the metal pattern of the metal pattern layer is relatively slow, but the metal pattern is uniformly formed. Thereafter, the electro-plating is performed so that the thickness of the metal pattern of the metal pattern layer formed by the electroless-plating process may increase quickly. Therefore, the final metal pattern layer may be totally uniformly formed and may have high ratio of width to thickness. Moreover, the metal pattern layer has high ratio of width to thickness, so that a signal line having small electric resistance and fast response may be formed.

Figure 13:
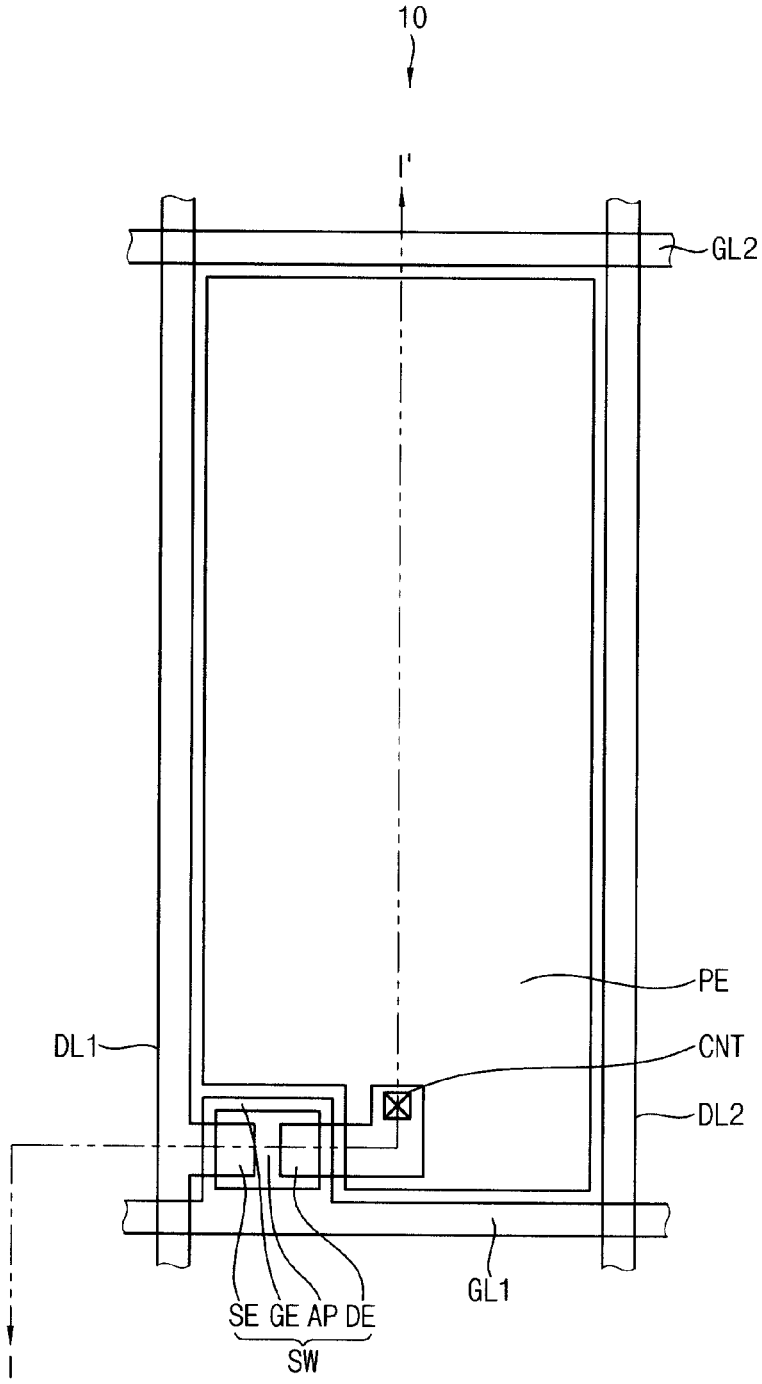
FIG. 13 is a plan view illustrating an exemplary embodiment of a display substrate manufactured by a method of manufacturing a display substrate according to the invention.
Figure 14:
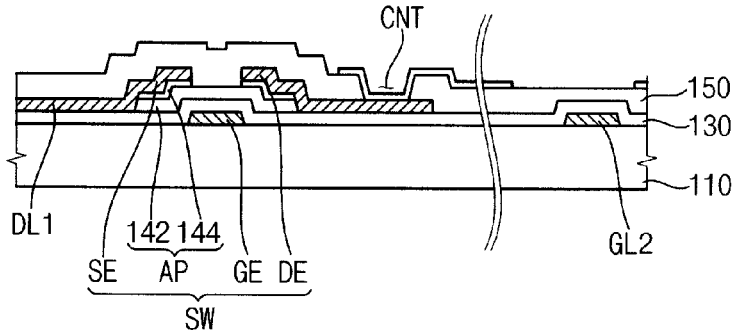
FIG. 14 is a cross-sectional view cut along line I-I' in FIG. 13.

FIG. 13 is a plan view illustrating an exemplary embodiment of a display substrate manufactured by a method of manufacturing a display substrate according to the invention. FIG. 14 is a cross-sectional view cut along line I-I' in FIG. 13.

Referring to FIGS. 13 and 14, a display substrate 10 includes first and second gate lines GL1 and GL2 on an insulting substrate 110, first and second data lines DL1 and DL2, and a switching element having a thin film transistor SW and a pixel electrode PE. The display substrate 10 may further include a gate insulting layer 130 and a passivation layer 150. An exemplary embodiment of a method of manufacturing the display substrate 10 will be explained in further detail referring to FIGS. 15A to 15C.

Figure 15A:
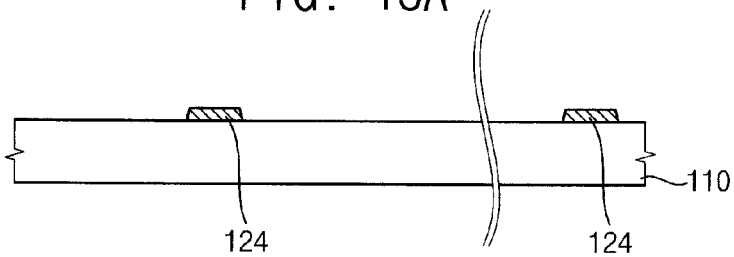
FIGS. 15A to 15C are cross-sectional views illustrating an exemplary embodiment of a method of manufacturing the display substrate in FIG. 13.
Figure 15B:
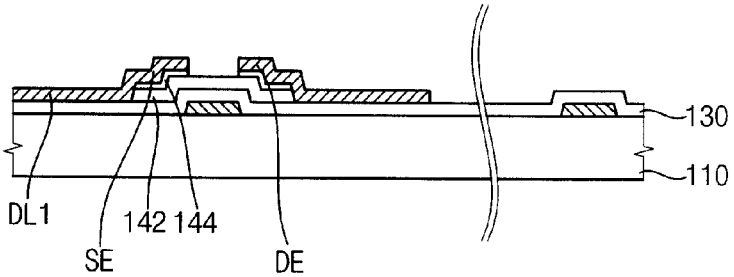
Figure 15C:
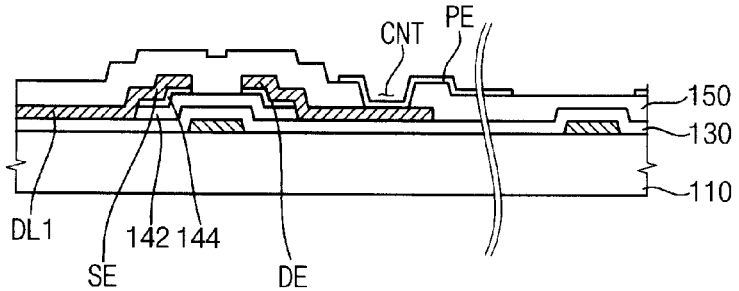

FIGS. 15A to 15C are cross-sectional views illustrating an exemplary embodiment of a method of manufacturing the display substrate 10 in FIG. 13.

Referring to FIGS. 13 to 15C, a gate pattern 124 including the first and second gate lines GL1 and GL2 and a gate electrode GE is formed on the insulting substrate 110. A method of forming the gate pattern 124 according to the illustrated exemplary embodiment is substantially the same as the method of forming a metal pattern according to the exemplary embodiment shown in FIGS. 1 to 7. Thus, any repetitive explanation will be omitted.

Referring to FIG. 15B, the gate insulating layer 130 is formed on the insulting substrate 110 where the gate pattern 124 is formed. Thereafter, a semiconductor pattern AP including a semiconductor layer 142 and an ohmic contact layer 144 is formed on the gate insulting layer 130, and a source pattern including the first and second data lines DL1 and DL2, a source electrode SE and a drain electrode DE is formed.

Referring to FIG. 15C, the passivation layer 150 is formed on the insulating substrate 110 where the source pattern is formed, and then a contact hole CNT is formed in the passivation layer 150. The pixel electrode PE is formed on the passivation layer 150 including the contact hole CNT, so that the display substrate 10 shown in FIG. 13 is manufactured.

Accordingly, total processes of forming a metal pattern on the substrate may be simplified. Moreover, an electroless-plating is performed after forming the metal seed layer so that a metal pattern having a uniform distribution can be formed on the substrate having large area.

According to the exemplary embodiments of the invention, the exposure process and the annealing process are sequentially performed in the one process of irradiating the light from single light source onto the substrate, so that total processes of forming a metal pattern on the substrate are simplified. Moreover, an electroless-plating is performed after forming the metal seed layer, so that a metal pattern having a uniform distribution can be formed on the substrate having large area.

Moreover, the electro-plating is performed after the electroless-plating so that the thickness of the metal pattern layer is increase efficiently. The metal pattern may be formed to have high ratio of width to thickness, so that a signal line having small electric resistance and fast response may be formed.

The foregoing is illustrative of the disclosure and is not to be construed as limiting thereof. Although a few exemplary embodiments of the invention have been described, those skilled in the art will readily appreciate that many modifications are possible in the exemplary embodiments without materially departing from the novel teachings and advantages of the disclosure. Accordingly, all such modifications are intended to be included within the scope of the disclosure as defined in the claims. In the claims, means-plus-function clauses are intended to cover the structures described herein as performing the recited function and not only structural equivalents but also equivalent structures. Therefore, it is to be understood that the foregoing is illustrative of the disclosure and is not to be construed as limited to the specific exemplary embodiments disclosed, and that modifications to the disclosed exemplary embodiments, as well as other exemplary embodiments, are intended to be included within the scope of the appended claims. Embodiments of the invention are defined by the following claims, with equivalents of the claims to be included therein.

What is claimed is:

1. A method of forming a metal pattern, the method comprising:

forming a precursor layer including a metal precursor, on a substrate;

irradiating a light on the precursor layer to form a metal seed layer comprising a plurality of discrete patterns arranged in a predetermined pattern on the substrate, comprising:

a light source irradiating the light in the predetermined pattern on the precursor layer to expose and reduce the precursor layer; and the same light source annealing the reduced precursor layer by the light; and electroless-plating the metal seed layer discrete patterns to form a metal pattern layer comprising a plurality of discrete patterns each formed from a group of the metal seed layer discrete patterns.

2. The method of claim 1, wherein the forming a precursor layer comprises:

applying the metal precursor on the substrate;

rotating the substrate to uniformly spread the metal precursor on the substrate; and drying the substrate.

3. The method of claim 1, wherein the forming a precursor layer comprises:

uniformly distributing the metal precursor on the substrate using a uniform droplet diffuser.

4. The method of claim 1, wherein the metal seed layer includes a first metal, and the metal pattern layer includes a second metal, a reducing power of the first metal is smaller than a reducing power of the second metal.

5. The method of claim 4, wherein the first metal includes at least one selected from copper (Cu), silver (Ag), titanium (Ti), gold (Au) and palladium (Pd).

6. The method of claim 4, wherein the electroless-plating the metal seed layer comprises exposing the substrate to a plating solution including a soluble oxidizer including the second metal.

7. The method of claim 6, wherein the first metal includes copper (Cu), and the second metal includes silver (Ag).

8. The method of claim 1, further comprising washing the precursor layer after the irradiating a light on the precursor layer.

9. The method of claim 1, wherein the irradiating a light on the precursor layer to form a metal seed layer further comprises irradiating the light from a light source disposed above and through a mask having a predetermined pattern, so that the precursor layer is exposed and annealed.

10. The method of claim 1, wherein the irradiating a light on the precursor layer to form a metal seed layer further comprises condensing the light by a condenser in a predetermined pattern, so that the precursor layer is exposed and annealed.

11. The method of claim 1, wherein a wavelength of the light has a bandwidth between about 180 nanometers and about 1000 nanometers.

12. The method of claim 11, wherein the light has the wavelength between about 180 nanometers and about 400 nanometers during the exposing the precursor layer, and the wavelength between about 400 nanometers and about 1000 nanometers during the annealing the precursor layer.

13. The method of claim 11, wherein the light is generated from a Xenon (Xe) lamp.

14. The method of claim 9, wherein the irradiating a light on the precursor layer to form a metal seed layer further comprises condensing and refining the light by a lens disposed under the mask.

15. The method of claim 14, wherein a plurality of lenses are disposed under the mask corresponding to the pattern of the mask.

16. The method of claim 1, further comprising electroplating the metal pattern layer on the substrate after the electro-less plating.

17. A method of manufacturing a display substrate, the method comprising:

forming a gate pattern including gate lines and a gate electrode, the forming a gate pattern comprising:

forming a precursor layer including a metal precursor, on a substrate, irradiating a light on the precursor layer to form a metal seed layer comprising a plurality of discrete patterns arranged in a predetermined pattern on the substrate, comprising a light source irradiating the light in the predetermined pattern on the precursor layer to expose and reduce the precursor layer; and the same light source annealing the reduced precursor layer by the light, and electroless-plating the metal seed layer discrete patterns to form a metal pattern layer comprising a plurality of discrete patterns each formed from a group of the metal seed layer discrete patterns;

forming a source pattern on the substrate including the gate pattern, the source pattern including date lines, a source electrode and a drain electrode; and forming a pixel electrode on the substrate including the source pattern, the pixel electrode in electrical connection with the drain electrode.

18. The method of claim 17, wherein a wavelength of the light has a bandwidth between about 180 nanometers and about 1000 nanometers, the light has the wavelength between about 180 nanometers and about 400 nanometers during the exposing the precursor layer, and the light has the wavelength between about 400 nanometers and about 1000 nanometers during the annealing the precursor layer.

* * * * *